US005693440A

United States Patent [19]

Barbur et al.

[11] Patent Number: 5,693,440

[45] Date of Patent: Dec. 2, 1997

[54] PROCESS VERIFICATION IN PHOTOGRAPHIC PROCESSES

[75] Inventors: Vicki Ann Barbur, Berkhamsted; Andrew Green, Harrow, both of England

[73] Assignee: Eastman Kodak Company, Rochester, N.Y.

[21] Appl. No.: 525,522

[22] PCT Filed: Mar. 7, 1995

[86] PCT No.: PCT/EP95/00837

§ 371 Date: Jun. 27, 1996

§ 102(e) Date: Jun. 27, 1996

[87] PCT Pub. No.: WO95/24673

PCT Pub. Date: Sep. 14, 1995

[30] Foreign Application Priority Data

Mar. 9, 1994 [GB] United Kingdom ..... 9404536

[51] Int. Cl.[6] ..... G03C 5/026

[52] U.S. Cl. ..... 430/30; 430/428

[58] Field of Search ..... 430/30, 428

[56] References Cited

U.S. PATENT DOCUMENTS 5,479,340 12/1995 Fox et al. ..... 364/153

OTHER PUBLICATIONS

Photogrammetric Engineering and Remote Sensing, Nasu et al. vol.42, No. 6, 06/76, pp.777–788.

A User's Guide To Principal Component, J.E. Jackson, 1991, John Wiley & Son, N.Y. pp. 51–58 and 123–141.

*Primary Examiner*—Hoa Van Le

*Attorney, Agent, or Firm*—William F. Noval

[57] ABSTRACT

The present invention relates to the use of multivariate statistical process control as a means of process verification in photographic processes. The method of the present invention allows the process to be controlled in a simple and effective manner by deriving $T^2$ for a series of variables which impact the material performance characteristics and comparing this value of $T^2$ with a standard value for the particular system. The contributions of scores to $T^2$ are used to interrogate changes in monitored process variables and to improve efficacy in maintaining and regaining the system in process control

7 Claims, 6 Drawing Sheets

PROCESS VERIFICATION IN PHOTOGRAPHIC PROCESSES

FIELD OF THE INVENTION

The present invention relates to process verification in photographic processes and is more particularly concerned with the application of multivariate statistical process control methods to these processes.

BACKGROUND OF THE INVENTION

It is well-known to control a process so that it operates within specified boundaries. This can be achieved using statistical process control (SPC) techniques which involve constant monitoring of the process. Such techniques may be univariate wherein a single variable of the process is monitored or multivariate where more than one variable is monitored. Multivariate SPC techniques are particularly well suited to use with complex processes in which a large number of variables are monitored routinely to assess the status of a particular process. Some of the variables may not be independent and the degree to which they are correlated is often unknown, and such processes cannot be assessed adequately with conventional control techniques.

A single parameter known as Hotelling's $T^2$ (Hotelling, H, (1931), *The Generalisation of Student's Ratio, Ann. Math. Statist.*, 2, pages 360–378) can be used successfully as an indicator in multivariate SPC techniques to determine the current status of the process. The parameter utilises all the information contained in the monitored variables as well as accounting for any correlation between them. The state of a process is determined by the magnitude of $T^2$, for example, if it exceeds the 95% limit, then the process is behaving in a significantly different way to that of the standard.

The underlying analysis required to deduce the $T^2$ parameter provides a method of quickly identifying causes of process failure. Corrective action guidelines (CAG) can be developed to facilitate the operation of the system and to provide help for common control failure conditions.

This technique has been applied previously for monitoring a photographic product, namely, black-and-white film as described in JACKSON, J. E. (1991), *A User's Guide to Principal Components*, pages 123–141, Wiley, N.Y. However, in the example described therein, the optical densities of all fourteen steps representing a series of graduated exposures on a piece of film designed to represent the entire range of practical exposures are measured. The purpose of the analysis, in this case, was to assess the effects of variability on a continuous curve shape, namely, the D-Log E curve.

In another example, concerned with colour film, a similar exposure to that described above is used to monitor the film over the normal picture taking range, but unlike the previous example, densities for only a few exposure levels were used for control purposes. In the particular example therein, only three levels were used in each colour record. One of these steps was in the high density region of the curve, another in the low density region, and a third in the middle section of the curve.

The physical interpretation of the principal components allows a process to be monitored based largely on control charts of the principal components. It is the principal component control chart which is considered an improved way of monitoring process variability in this particular example. In particular, the use of generalised $T^2$ statistics and the breakdown of $T_o^2$, the overall variability of a subgroup about an aim or grand mean, into $T_D^2$, a measure of the variability of the subgroup about its mean, and $T_m^2$, a measure of the distance of the subgroup mean from the target, as an indicator for individual observation and process variability, respectively, being out-of-control.

PROBLEM TO BE SOLVED BY THE INVENTION

Process control is commonly achieved by using the D-Log E curve and either assigning band limits into which the curve can fall or applying limits for each parameter in the process using univariate methods. This allows large changes in the D-Log E curve which produces unacceptable results, for example, high speed and low contrast. This produces a non-optimised combination of parameters affecting the end results of the process being controlled.

It has been difficult to detect problems in photographic processes, and in particular, in critical fields such as radiology. In particular, in radiology, it has been a problem keeping the process for producing medical photographic images in control due to the number of variables of the process.

Furthermore, it has been relatively difficult to use the techniques of multivariate SPC in the past largely because of the scarcity of computing technology.

SUMMARY OF THE INVENTION

However, now with improvements in technology and the availability of computers in all industries, it is possible to utilise more efficient methods, for example, multivariate SPC techniques, which increase the ability to detect problems in processes such as radiology. Moreover, multivariate SPC techniques increase the sensitivity for detecting out-of control conditions compared with existing methods.

It is therefore an object of the present invention to provide an improved method of carrying out process verification for a photographic process using Hotelling's $T^2$ parameter as part of a multivariate statistical process control technique.

It is a further object of the present invention to derive a $T^2$ algorithm which will allow routine determination of the $T^2$ parameter for a photographic process. This procedure could then become part of the control software for processors and can be used regularly for process control in photographic processing departments to monitor their process on a day-to-day basis.

In accordance with one aspect of the present invention, there is provided a method of verifying and controlling a photographic process using multivariate statistical process control, characterized in that Hotelling's $T^2$ parameter exceeds a predetermined from a range of monitored variables.

If the $T^2$ parameter exceeds a predetermined limit, the contribution of the scores to that $T^2$ parameter value is interrogated to determine which score is the primary contributor. The score which forms the primary contributor is interrogated further to assess which of the monitored variables is of significance.

Preferably, the range of monitored variables includes base and fog, slope, maximum density ($D_{max}$), relative speed, lower shoulder contrast and upper shoulder contrast, and any other suitable variables (for example, latitude as described in EP-A-0 601 626 (publication of European patent application 93 203 291.5 filed 25 Nov. 1993)).

An additional parameter $Q_{res}$ may also be determined for the process. If either of the $T^2$ or $Q_{res}$ parameters exceeds predetermined limits, then it indicates a significant change compared with the reference system.

$T^2$ and $Q_{res}$ monitor different out-of-control behaviour, $T^2$ assessing systematic variability within the model and $Q_{res}$ the systematic non-random variability not captured by the model.

ADVANTAGEOUS EFFECT OF THE INVENTION

The method of the present invention provides simple parameters, namely $T^2$ and $Q_{res}$, which can be used in the everyday control of photographic processes. The present invention has particular application in the field of radiology where deviation of the process from the D-Log E curve may be critical. Moreover, the potential benefit of using the Hotelling's $T^2$ parameter in process control is that it yields vital information which can be used to correct any control failure problems with efficacy.

Other benefits to radiology departments, in particular, include decreasing the probability of rejected radiographs from processing problems and eliminating the need for repeated exposure of patient's to unnecessary radiation.

Using the method according to the present invention, other measured variables which impact the performance characteristics of the imaging material, for example, X-ray film, can be also included as an extension to the method if desired.

The method of the present invention has greater efficacy and produces superior results to those of traditional univariate approach in the field of photographic processing.

Process verification is achieved by means of the $T^2$ parameter and CAGs allow problems to be isolated and corrected with minimal resources. It may be possible to build photographic material type changes, for example, for films or papers, into the algorithm used to determine $T^2$.

The method of the present invention provides a technique which is not normally applied to photographic processes, nor has it been applied to medical imaging in particular. Furthermore, the range of parameters which are being considered for multivariate SPC, namely, base and fog (B & F), slope, $D_{max}$, relative speed, lower shoulder contrast (LSC) and upper shoulder contrast (USC) have not been controlled in this way before. These parameters are discussed in *The Theory of the Photographic Process,* Mees & James, Third Edition, published by Macmillan, 1966.

It is to be noted that these parameters are material dependent and different aims and limits will be required for each material. The method of the present invention is useful in determining when a change of material has taken place without making the necessary adjustments for that particular material.

Advantageously, it is possible to determine the aim and limits for a system in terms of all monitored parameters. Furthermore, an immediate assessment of any individual control test relative to chosen limits can be provided.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
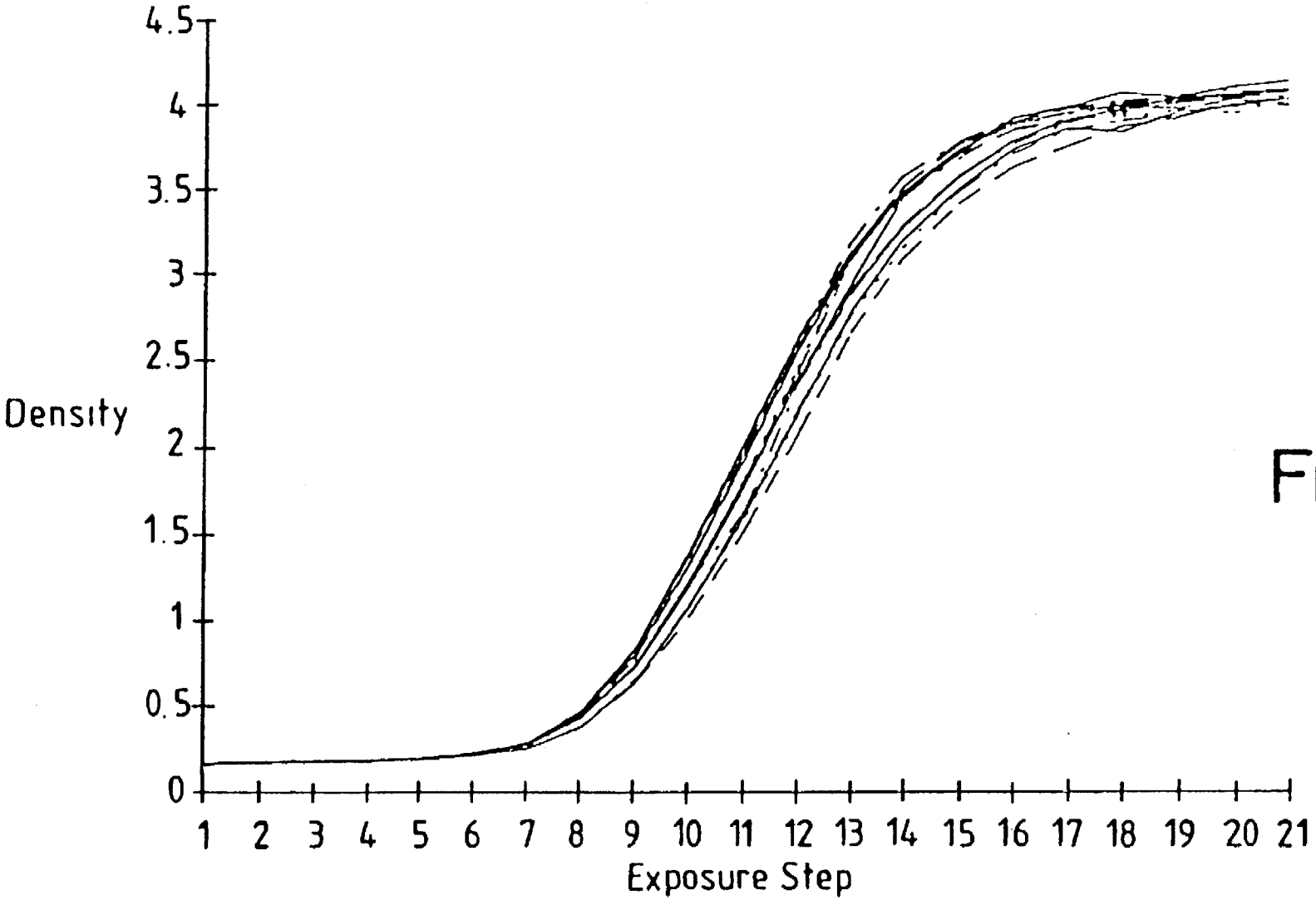
FIG. 1 shows density against log exposure (D-Log E) curves for twenty control strips from the same film batch.
Figure 2:
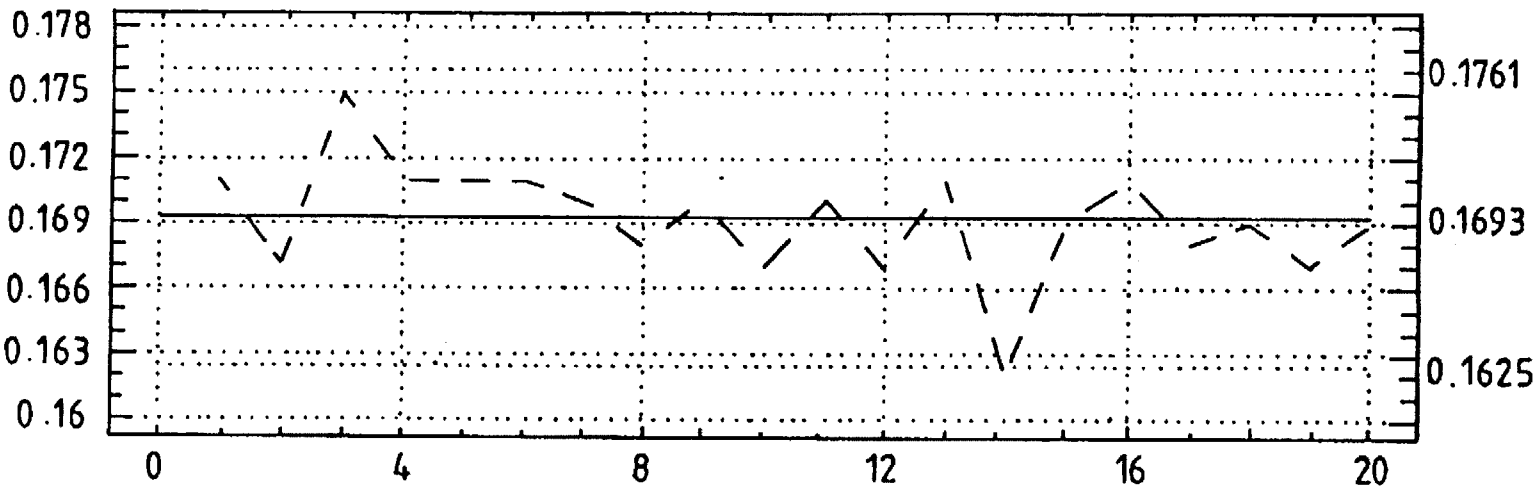
FIG. 2 shows a control chart for individual measurements of base and fog.
Figure 3:
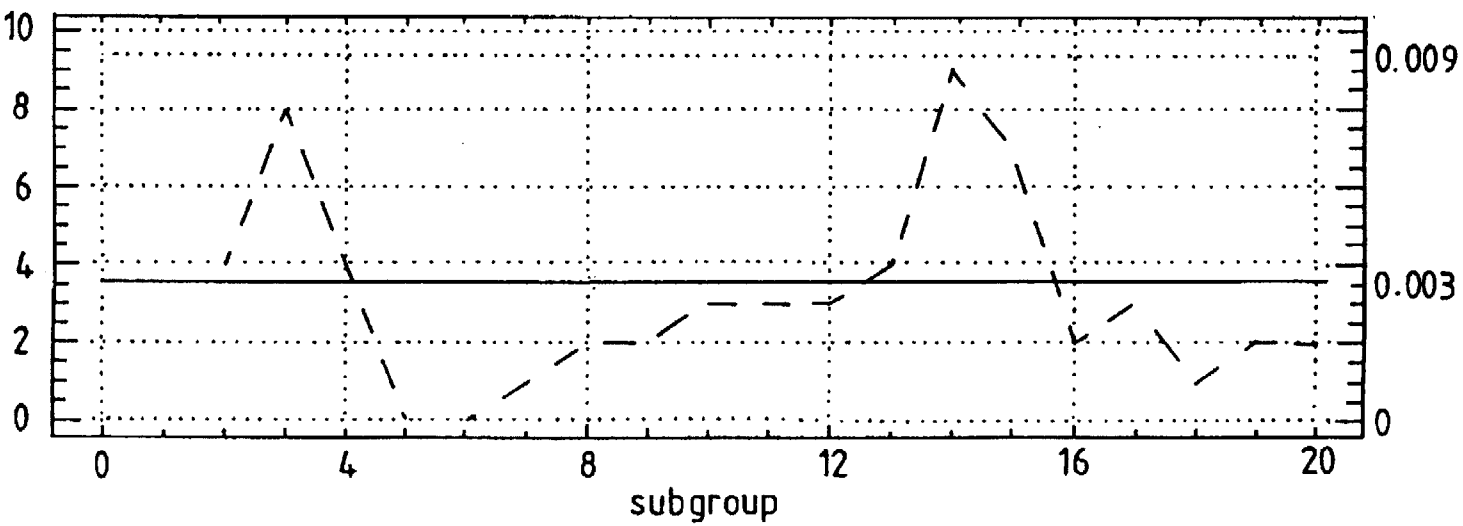
FIG. 3 shows a moving range chart for the measurements shown in FIG. 2.
Figure 4:
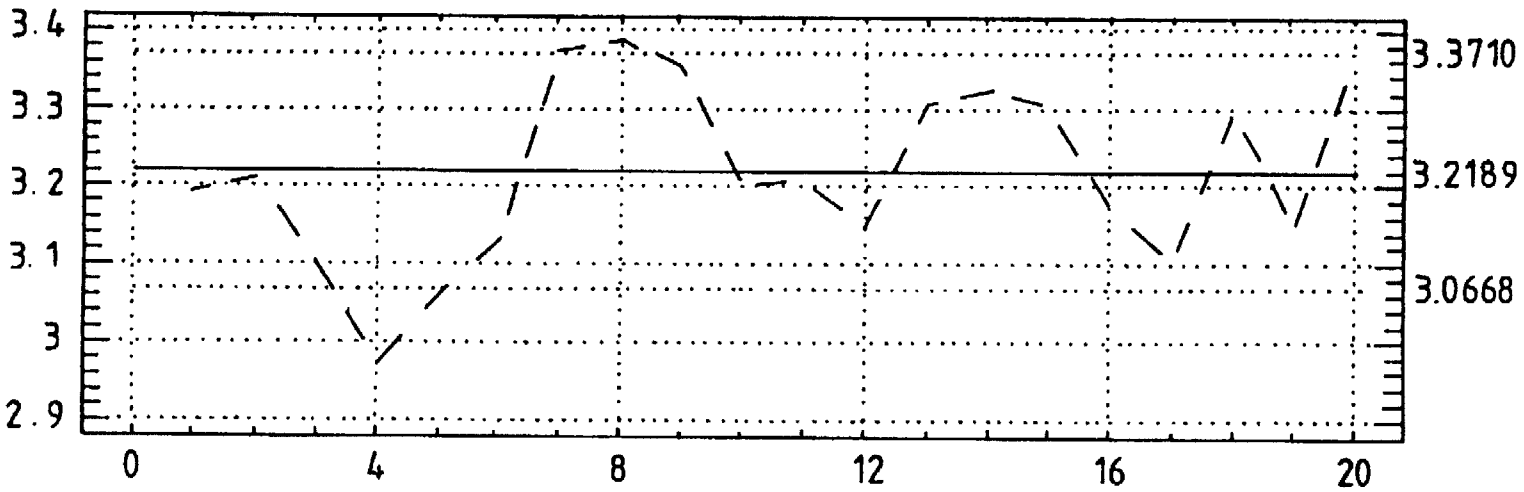
FIG. 4 shows a control chart for individual measurements of slope.
Figure 5:
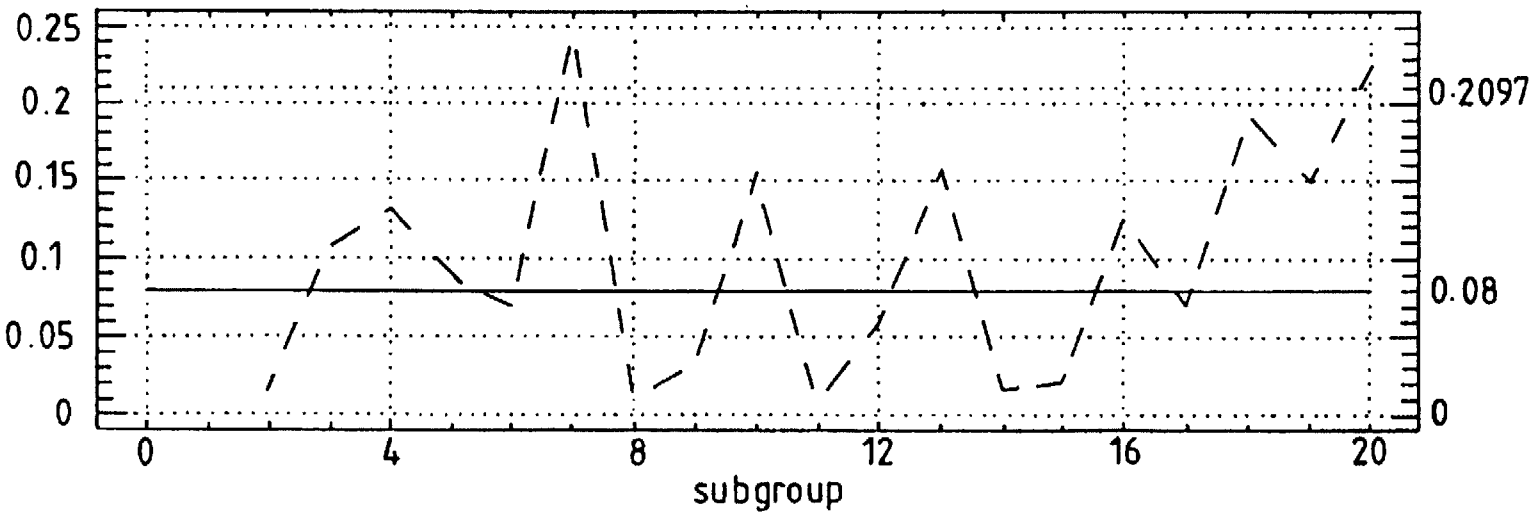
FIG. 5 shows a moving range chart for the measurements shown in FIG. 4.
Figure 6:
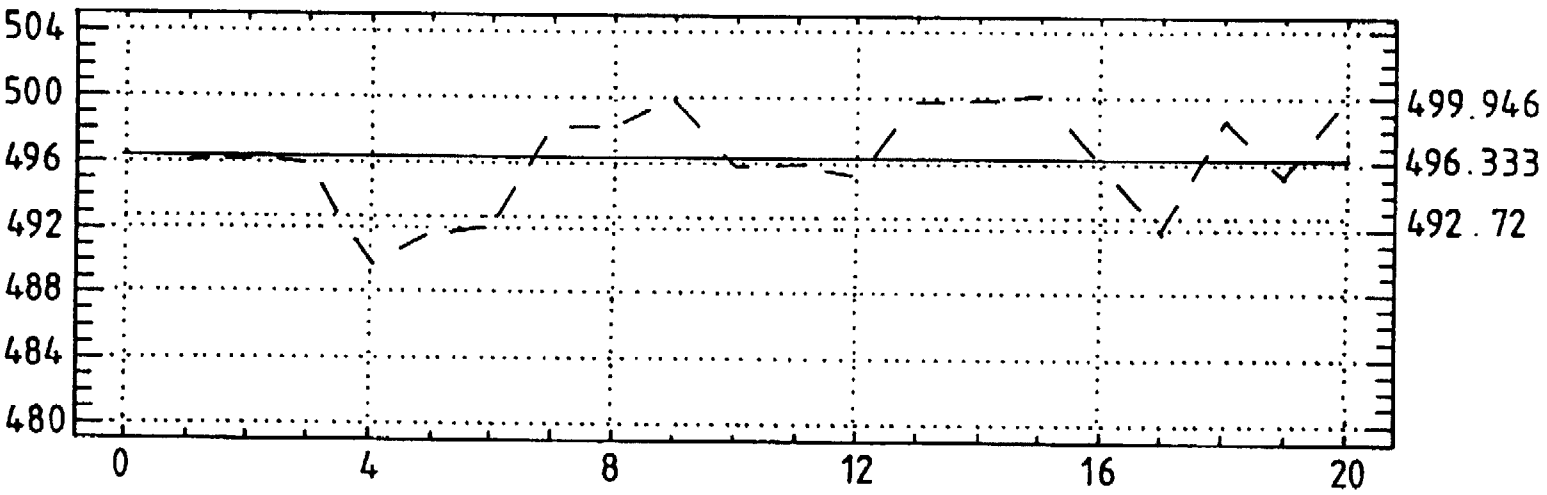
FIG. 6 shows a control chart for individual measurements of relative speed.
Figure 7:
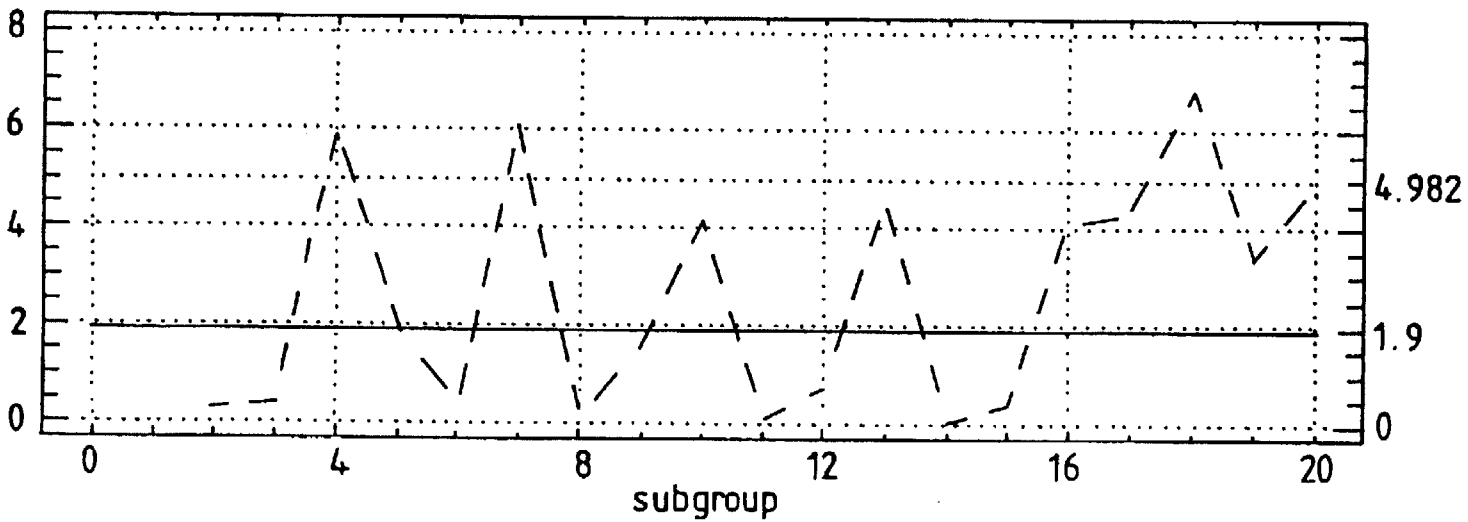
FIG. 7 shows a moving range chart for the measurements shown in FIG. 6.
Figure 8:
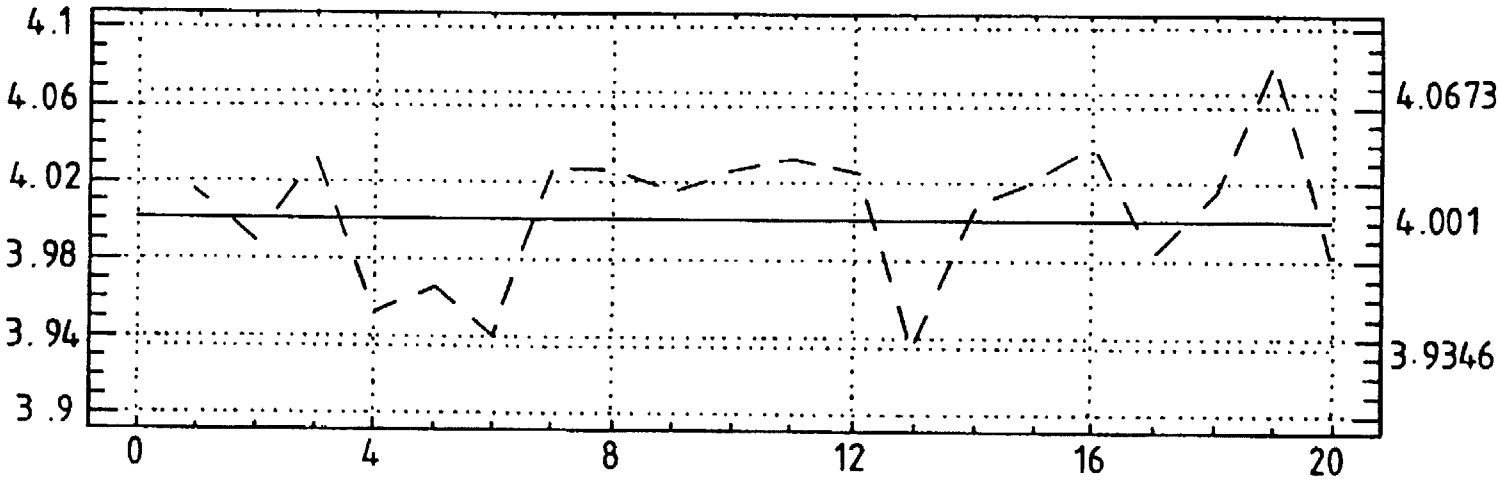
FIG. 8 shows a control chart for individual measurements of $D_{max}$.
Figure 9:
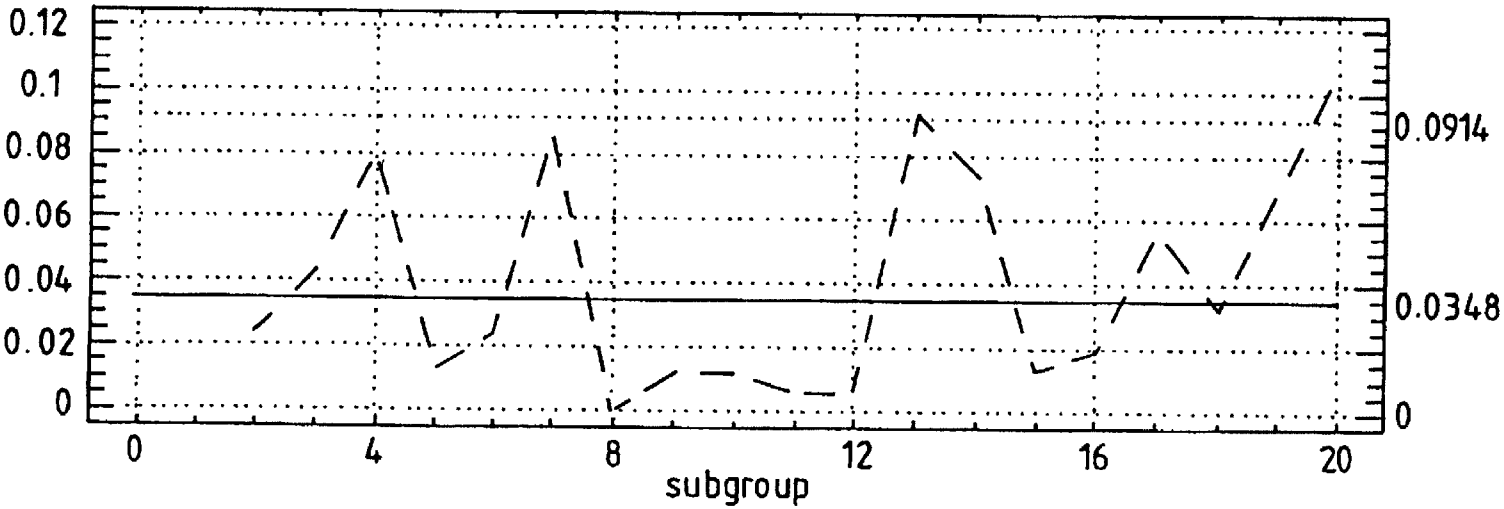
FIG. 9 shows a moving range chart for the measurements shown in FIG. 8.

Twenty control strips from the same film batch were processed in groups of four in five different processors at four separate Breast Screening Units in the South of England. The film batch was a green-sensitive high speed film for mammography. All of the control strips were exposed in the same sensitometer. FIG. 1 shows the D-Log E curves obtained for the twenty control strips.

As can be seen from the results in FIG. 1, all the control strips fall within conventional process control limits. Using previous batches of film, it has been shown that processors at these sites are also well matched with processors in Sweden.

Several parameters are routinely extracted from the curves for these control strips, namely, base and fog, slope, relative speed, $D_{max}$, temperature, DIN-speed, DIN-slope, LSC and USC etc. Individual control charts for this number of variables are difficult to assess accurately and efficiently, largely because a series of univariate charts are produced for each parameter.

FIGS. 2 to 9 show typical examples of these charts for four parameters, namely, base and fog, slope, relative speed and $D_{max}$. In each of FIGS. 2, 4, 6 and 8, the control chart for the individual measurements is shown, with the means and 95% limits based on $\pm 2\sigma$. Naturally, other limits may be applied depending on the particular application.

FIGS. 3, 5, 7 and 9 respectively show the moving range chart for the measurements based on the difference between two successive measurements for each of FIGS. 2, 4, 6 and 8. Principal component analysis (PCA) is then used with the data extracted from the series of curves.

In this case, the variables characterising the process are base and fog (B & F), slope, relative speed (R.SPD), $D_{max}$, lower scale contrast (LSC) and upper scale contrast (USC). The values obtained are given in Table I below.

TABLE I

| | B & F | SLOPE | R.SPD | $D_{max}$ | LSC | USC |
|---|---|---|---|---|---|---|
| 1 | 0.171 | 3.194 | 4960 | 4.015 | 2.270 | 3.629 |
| 2 | 0.167 | 3.211 | 496.3 | 3.990 | 2.254 | 3.587 |
| 3 | 0.175 | 3.104 | 495.9 | 4.033 | 2.271 | 3.912 |
| 4 | 0.171 | 2.973 | 489.9 | 3.952 | 2.177 | 3.531 |
| 5 | 0.171 | 3.061 | 491.7 | 3.965 | 2.265 | 3.592 |

TABLE I-continued

| | B & F | SLOPE | R.SPD | $D_{max}$ | LSC | USC |
|---|---|---|---|---|---|---|
| 6 | 0.171 | 3.131 | 492.1 | 3.941 | 2.267 | 3.653 |
| 7 | 0.170 | 3.376 | 498.2 | 4.027 | 2.339 | 3.970 |
| 8 | 0.168 | 3.388 | 498.3 | 4.027 | Z.344 | 3.976 |
| 9 | 0.170 | 3.355 | 499.9 | 4.015 | 2.265 | 4011 |
| 10 | 0.167 | 3.200 | 495.8 | 4.027 | 2.237 | 4.226 |
| 11 | 0.170 | 3.208 | 495.9 | 4.033 | 2.224 | 4.249 |
| 12 | 0.167 | 3.150 | 495.2 | 4.027 | 2.230 | 3.868 |
| 13 | 0.171 | 3.307 | 499.8 | 3.934 | 2.282 | 3.891 |
| 14 | 0.162 | 3.324 | 499.8 | 4.008 | 2.268 | 3.867 |
| 15 | 0.169 | 3.302 | 500.2 | 4.021 | 2.367 | 3.793 |
| 16 | 0.171 | 3.175 | 496.1 | 4.040 | 2.258 | 3.540 |
| 17 | 0.168 | 3.105 | 491.8 | 3.983 | 2.265 | 3.690 |
| 18 | 0.169 | 3.298 | 498.6 | 4.015 | 2.317 | 3.941 |
| 19 | 0.167 | 3.148 | 495.2 | 4.084 | 2.231 | 3.886 |
| 20 | 0.169 | 3.371 | 500.1 | 3.977 | 2.387 | 3.877 |
| 21 | 0.170 | 3.315 | 501.1 | 4.035 | 2.329 | 3.961 |
| 22 | 0.170 | 3.211 | 505.1 | 4.166 | 2.276 | 3.964 |
| 23 | 0.171 | 3.331 | 503.6 | 4.055 | 2.340 | 3.980 |
| 24 | 0.168 | 3.105 | 491.8 | 3.983 | 2.265 | 3.690 |
| 25 | 0.168 | 3.108 | 492.3 | 3.987 | 2.268 | 3.694 |

The PCA model of the system is based on a set of data which is known to represent controlled conditions in the process. In this case, fifteen curves were used so that the five additional curves could be used to validate the model. Any final model would require data from a wider selection of control sites so as to ensure that a normal population is being dealt with. The overall result would maintain process performance at all sites within clearly defined limits until an assignable cause changed the operating conditions, for example, film type change.

PCA produces a set of components which are derived from a linear transformation of the original variables. The major difference is that the new components are independent and orthogonal to each other. A sufficient number of the new components are extracted so as to form a model which accounts for a significant amount of variability in the original data for a reference process or system. In this way, the dimensionality of the problem is reduced and is more apparent the larger the number of variables which are consistently monitored in the process.

In this case, only four principal components are required to account for 95% of the variability in the original data set. Hotelling's $T^2$ is then derived from the sum of the squares of the scores of each of the principal components included in the model, for example, when applied to a new set of monitored variables in the process. The 95% limit on $T^2$ is determined by the number of components in the model, the size o the original data set and the Fisher F variance ratio test as defined in *Statistical Methods*, Seventh Edition, 1980, G. W. Snedecor & W. G. Cochran, Iowa State University Press.

Hotelling's $T^2$ parameter for two variables, namely x and y, with means $\bar{x}$ and $\bar{y}$, standard deviations of $s_x$ and $s_y$ and with some correlation indicated by the covariance $s_{xy}$ is given by the equation:

$$T^2=\frac{s_x^2 s_y^2}{s_x^2 s_y^2-s_{xy}^2}\left[\frac{(x-\bar{x})^2}{s_x^2}+\frac{(y-\bar{y})^2}{s_y^2}-\frac{2s_{xy}(x-\bar{x})(y-\bar{y})}{s_x^2 s_y^2}\right]$$

and can be easily extended using matrix notation to n dimensions as follows:

$$i\ T^2=[x-\dot{x}]'S^{-1}[x-\dot{x}]$$

where

S is the covariance matrix $[x-\dot{x}]$ is the matrix of data corrected with respect to the means.

In PCA, $T^2$ is merely the sum of squares of the weighted scores of the principal components included in the model.

An additional parameter, $Q_{res}$, is also calculated. $Q_{res}$ is a weighted sum of the squares of the scores of the principal components not included in the model and is given by:

$$Q_{res}=(x-\hat{x})'(x-\hat{x})$$

where x is the matrix of data; and $\hat{x}$ is the matrix of estimates of x from the model.

The value of $T^2$ and $Q_{res}$ are calculated for any subsequent situation and compared with the 95% limits defined for the system. (Naturally, limits other than 95% can be set in accordance with a particular application.) If either parameter exceeds the limits then there has been a significant change in the process which is likely to affect the results, that is, the performance characteristics of the film.

For example, if the $T^2$ parameter exceeds the 95% limit, the exact reason can be identified quickly by examining the contribution to the scores producing the high value of the $T^2$ parameter. The highest score is then used to assess which of the monitored variables has resulted in the out-of-control condition (control failure). The or each monitored variable found to be producing the out-of control condition is then adjusted to bring the process back into control in line with the CAGs mentioned above.

In most cases, $T^2$ and $Q_{res}$ exceed limits simultaneously. If $Q_{res}$ alone exceeds the limit then the indication is that the distribution of variability within the process has changed significantly. Then, the present model is no longer an adequate predictor of the system.

Figure 10:
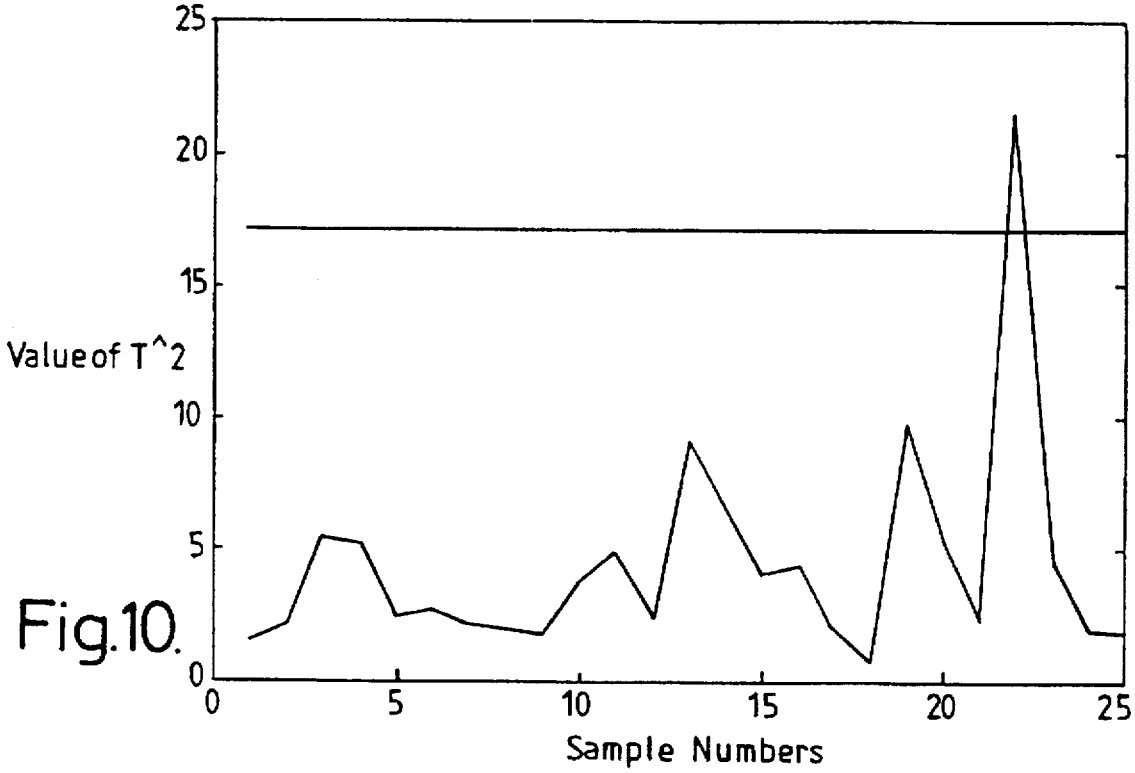
FIG. 10 shows a graph of the $T^2$ parameter for each control strip.
Figure 11:
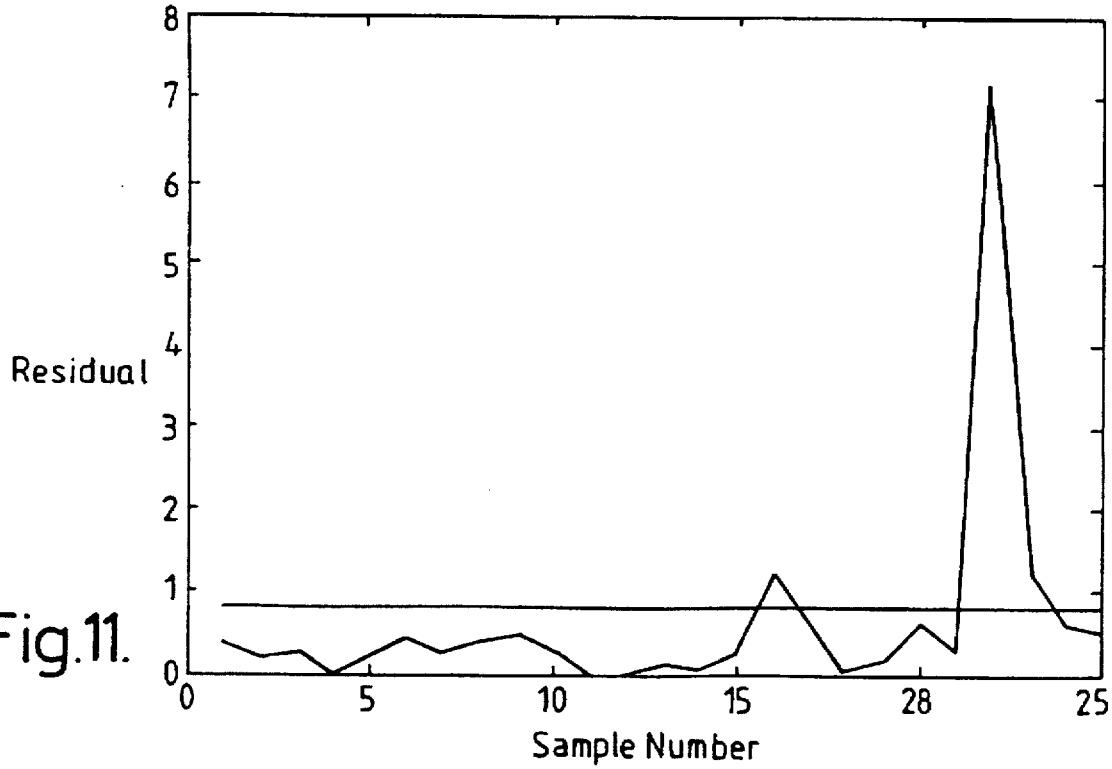
FIG. 11 shows a graph of $Q_{res}$ for each control strip.

$T^2$ and $Q_{res}$ charts for this specific example are respectively shown in FIGS. 10 and 11. The first fifteen data points in each of FIGS. 10 and 11 represent the data on which the PCA model is based. These are effectively the training set and are used to define the reference system. $T^2$ and $Q_{res}$ parameters indicate that the processes are in control with respect to the monitored variables.

The next five points represent the validation set which are derived in effect from the same sources. They show generally that the system is in good control, except that data point 16 is in control as far as $T^2$ is concerned (FIG. 10) but out-of-control as defined by $Q_{res}$ (FIG. 11). This result indicates that a shift in the distribution of variability amongst the principal components has taken place.

To achieve this position, all the variables are standardised, that is, transformed so that they have a mean of zero and variance of one.

The application of PCA techniques result in a $T^2$ which is the sum of the squares of the scores of the principal components included in the model. A score is derived for each set of data collected for all principal components in the model since each is a linear transformation of the original standardised variables.

When the $T^2$ term exceeds the 95% limit (as shown in FIG. 10), thus indicating an out-of-control situation, it is very easy to track back and establish which variable (or variables) are contributing to this situation, for example, the largest score which contributes to the high $T^2$ value is identified. This score is then broken down into the contributions from the original standardised variables. If this procedure is carried out graphically then the contributions are displayed as a bar chart. The size of each bar represents the contribution of each variable to the particular score. The largest bars identify those variables having the largest contribution to the high score and this indirectly to $T^2$. Assignable causes are then established for those variables where the variability has exceeded the normal range and led to large contributions in the score and the subsequent out-of-control situation. Once the assignable cause or causes has/have been eliminated, the process should return to an in-control position again.

A similar procedure can be used with the contributions to $Q_{res}$. However, the two terms are used effectively to monitor two different types of out-of-control behaviour. For example, $T^2$ assesses non-systematic variability within the model, whereas $Q_{res}$ looks for systematic non-random variability not captured by the model.

The last five points represent new processors in which there has been a systematic change. The results demonstrate clearly another out-of-control point since both $T^2$ and $Q_{res}$ terms exceed limits for the system. In this case, not only has there been a shift in the distribution of variability but also it is likely that the correlation between variables has changed significantly.

In the example described above, process verification is achieved by applying PCA to the data extracted from each sensitometric strip. All the parameters on which PCA is based are assumed to have equal importance in the process.

In other examples, the importance of certain parameters may be emphasised with respect to the relationship with other process responses by the use of Partial Least Squares (PLS).

PLS is a multivariate statistical technique which is closely related to PCA in all other respects. The same parameters, namely, $T^2$ and $Q_{res}$ can be derived from the results of an analysis so as to allow efficient and effective interpretation of why a process has failed.

The present invention is not restricted to a colour film process or the use of the variables required for the technique mentioned on page 2 of the present specification. It is a procedure for statistical process control which can be applied to photographic processes in general and can work with any parameters which are logged at any state in the system. The parameters could be those measured from control strips, as is the case of base and fog or $D_{max}$ in or example, or parameters which are derived by traditional methods or by the use of the method described in EP-A-0 601 626 mentioned above, the disclosure of which is incorporated herein by reference, such as, slope, relative speed, lower scale contrast and upper scale contrast.

Additionally, variables associated with the photographic process itself could be included in the analysis, for example, the concentration of hydroquinone, the concentration of bromide, the temperature and the agitation of the processing solutions.

Although the present invention has been described with reference to medical imaging film materials, it will be readily understood that the invention is equally applicable to all photographic imaging systems, for example, negative and reversal systems, black-and-white and colour systems, as well as paper, film and photographic plate systems.

We claim:

1. A method of verifying and controlling a photographic process using multivariate statistical process control, characterized in that Hotelling's $T^2$ parameter is determined for the process from a first range of monitored variables and an additional parameter $Q_{res}$ is determined for a second range of monitored variables different than said first range of monitored variables, wherein a significant change from the standard is indicated if either the $T^2$ or $Q_{res}$ parameters exceeds predetermined limits.

2. A method according to claim 1, wherein if the $T^2$ parameter exceeds a predetermined limit, the contribution of the scores to that $T^2$ parameter value is interrogated to determine which score is the primary contributor.

3. A method according to claim 2, wherein the score which forms the primary contributor is interrogated further to assess which of the monitored variables is of significance.

4. A method according to claim 1, wherein an additional parameter $Q_{res}$ is also determined, the process indicating a significant change from a standard if either of the $T^2$ or $Q_{res}$ parameters exceeds predetermined limits.

5. A method according to claim 1, wherein the range of monitored variables includes base and fog, slope, maximum density ($D_{max}$), relative speed, lower shoulder contrast and upper shoulder contrast.

6. A method according to claim 1, wherein the multivariate statistical process control includes principal component analysis (PCA).

7. A method according to claim 1, wherein the multivariate statistical process control includes partial least squares (PLS).

* * * * *